US005828922A

United States Patent [19]

Piccinino, Jr. et al.

[11] Patent Number: 5,828,922

[45] Date of Patent: Oct. 27, 1998

[54] DUAL PROCESSING MODULE FOR PHOTOSENSITIVE MATERIAL

[75] Inventors: Ralph L. Piccinino, Jr., Rush; John H. Rosenburgh, Hilton, both of N.Y.

[73] Assignee: Eastman Kodak Company, Rochester, N.Y.

[21] Appl. No.: 947,421

[22] Filed: Oct. 8, 1997

[51] Int. Cl.[6] ..... G03D 3/08

[52] U.S. Cl. ..... 396/622; 396/624; 396/636

[58] Field of Search ..... 396/612, 615, 396/616, 617, 620, 622, 624, 636

[56] References Cited

U.S. PATENT DOCUMENTS 3,699,869 10/1972 Jensen ..... 396/616
4,907,023 3/1990 Koboshi et al. ..... 396/620
5,347,337 9/1994 Patton et al. ..... 396/322

*Primary Examiner*—A. A. Mathews
*Attorney, Agent, or Firm*—Peyton C. Watkins

[57] ABSTRACT

A processing apparatus for processing of photographic material, the apparatus comprises a first plurality of successive processing tanks, each containing a processing solution. The plurality of first tanks form a first processing path for a first photographic material. A second plurality of successive processing tanks, each containing a processing solution, form a second processing path for processing a second photographic material. The first and second plurality of tanks are disposed adjacent each other. A first transport system drives the first photographic material through the first processing path, and a second transport system drives the second photographic material through the second processing path. A single common drive drives both said first and second transport systems.

5 Claims, 4 Drawing Sheets

DUAL PROCESSING MODULE FOR PHOTOSENSITIVE MATERIAL

FIELD OF THE INVENTION

The invention relates to the field of photography and, more particularly, to a photosensitive material processing apparatus.

BACKGROUND OF THE INVENTION

The processing of photosensitive material involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution.

Typically large photofinishing apparatus and microlabs utilize fixed and integrated horizontal and vertical arrangements of racks and tanks. The problem with fixed or integrated photofinishing apparatus and microlabs is that their rack and tank configuration are arranged on a horizontal surface i.e. a floor. This arrangement requires a large amount of floor space.

In addition, the foregoing arrangement of racks and tanks is fixed according to the photographic process steps (developer, bleach, fix and wash) being utilized in the photographic processor. If the site that one wants to utilize for the photographic processor did not contain sufficient horizontal floor space, the photographic processor could not be installed. In the event, if an existing photographic processor was placed in a horizontal space and one wanted to modify the processes sequentially performed in the processor by adding additional racks and tanks, one is constrained by the amount of horizontal space available.

Still further, if separate and distinct minilab arrangements are placed on the same floor space for permitting a plurality of parallel processing paths, each rack and tank arrangement utilizes its own mechanical driving devices. This requires space and separate drive devices, and it is obviously energy inefficient.

Consequently, a need exists for a rack and tank arrangement that overcomes the above-described drawbacks.

SUMMARY OF THE INVENTION

The present invention is directed to overcoming one or more of the problems set forth above. Briefly summarized, according to one aspect of the present invention, the invention resides in a processing apparatus for processing of photographic material, the apparatus comprising: (a) a first plurality of successive processing tanks, each containing a processing solution, said plurality of first tanks forming a first processing path for a first photographic material; (b) a second plurality of successive processing tanks, each containing a processing solution, said second plurality of tanks forming a second processing path for processing a second photographic material, said first plurality of tanks being disposed adjacent said second plurality of processing tanks; (c) a first transport system for driving of said first photographic material through said first processing path; (d) a second transport system for driving of said second photographic material through said second processing path; and (e) a single common drive for driving both said first and second transport systems.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECT OF THE INVENTION

The present invention has the advantage of permitting parallel processing paths which utilize shared driving devices for improving energy efficiency. Still further, the present invention conserves space by permitting integral attachment of the two parallel processing paths.

DETAILED DESCRIPTION OF THE INVENTION

Figure 1:
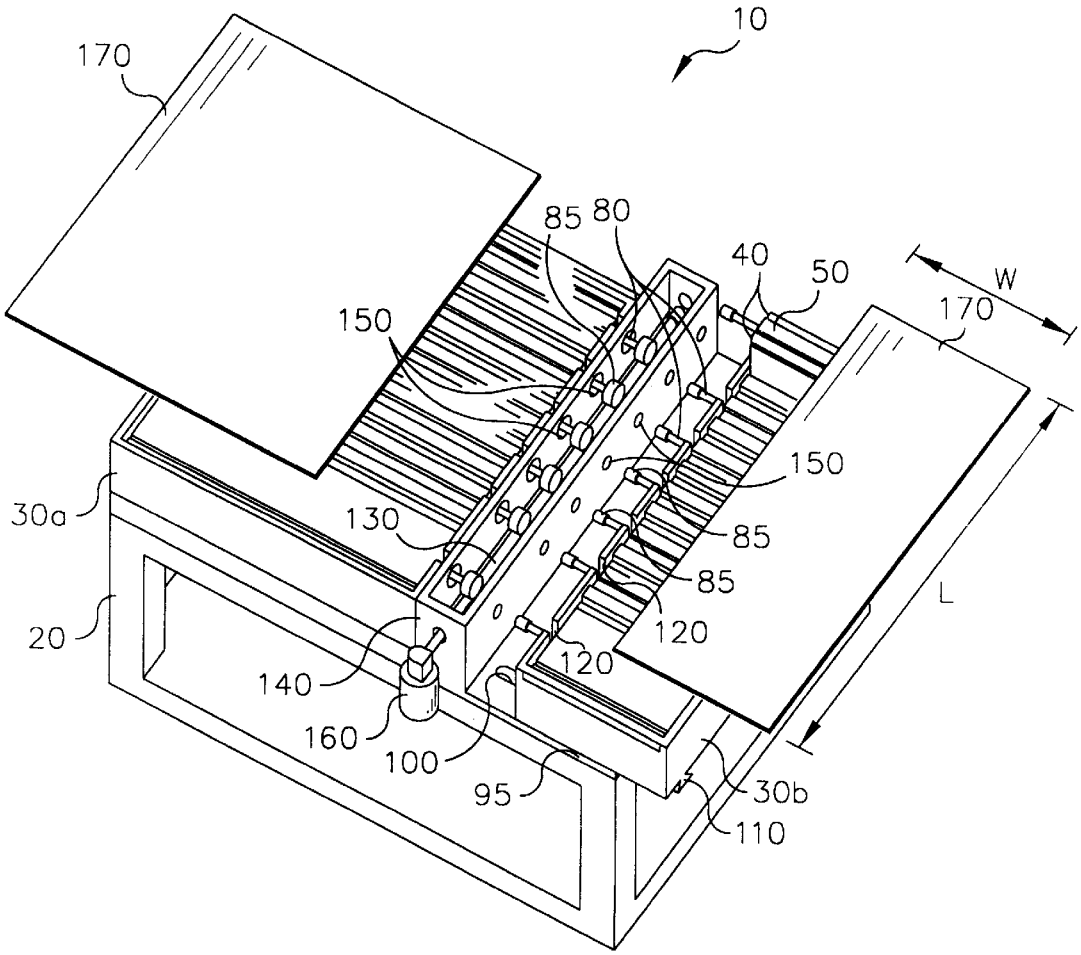
FIG. 1 is a perspective view of a processing module of the present invention.

Referring to FIG. 1, there is illustrated a perspective view of a processing module 10, which may stand alone or be combined with other processing modules, for forming a continuous low volume unit for processing photosensitive materials. The module 10 includes a stand 20 for elevating the top portion of the module 10 for ease of use. The top portion of the module 10 also includes two containers 30*a* and 30*b* for forming an enclosure in which the processing occurs. Each container 30 includes a width (W) and length (L), and each forms a separate and distinct processing path that functions simultaneously and in parallel to each other. It is instructive to note that each container 30 includes substantially similar components therein, and for brevity, only one container, i.e., 30*b*, will be described although it is to be understood that the following description of the components of the tank applies to each container 30.

Figure 2:
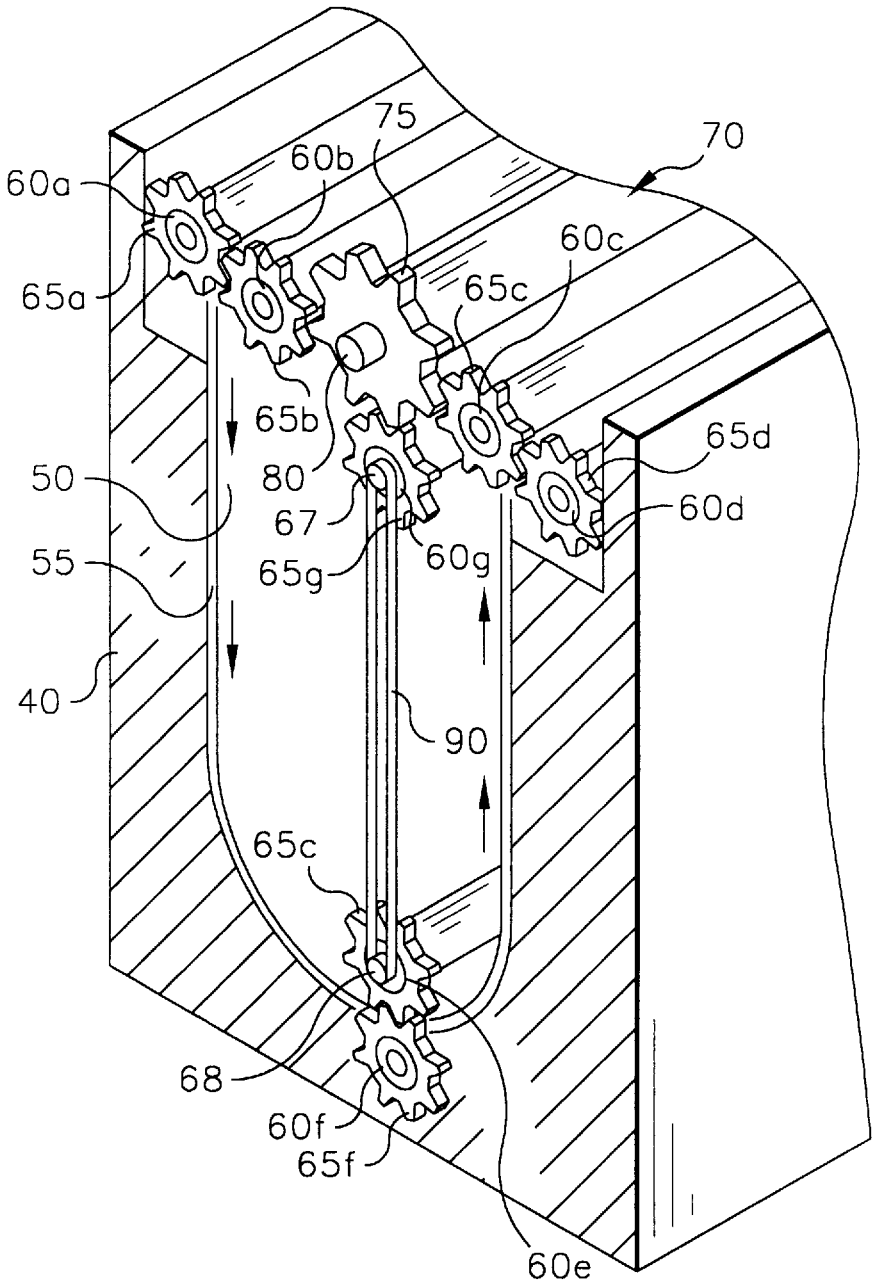
FIG. 2 is a side view of a container having a rack therein of the present invention.

Referring to now FIGS. 1 and 2, the container 30*b* includes a plurality of hollowed-out tanks 40 that together contain the processing solutions for the container 30*b*. A plurality of spaced-apart, U-shaped racks 50 are positioned in the tank for permitting the processing solution to contact the photosensitive material as the material passes through a channel 55 along its peripheral surface, as illustrated by the arrows. The processing solution passes through the channel 55 of the racks 50 and tank sections 40, as is well known in the art and therefore will not be discussed in detail. A plurality of driven rollers 60*a*–60*g* are paired together, and are disposed across the width (W) of the container 30*b* for urging the photosensitive paper along the peripheral surface of the rack 50. The rollers 60 respectively include a gear 65*a*–65*g* at each end that meshes with its corresponding paired gear 65 for providing simultaneous rotation of the paired rollers, for example 60*a* is paired with 60*b*.

A rack or module drive shaft 70 is also positioned at the center portion of the rack 50, and also includes a drive gear 75. The drive gear 75 is mated to three gears 65*b*, 65*c* and

65*g* of the driven rollers 60*b*, 60*c* and 60*g* for causing rotation of the driven rollers 60*b*, 60*c* and 60*g* simultaneous with rotation of the drive shaft 70. Two projections 67 and 68 respectfully extend from both one end of the driven roller 60*g* and one end of one of the driven roller 60*e*, and a drive link 90 is attached between the two projections 67 and 68 for causing rotation of the linked pair of driven rollers 60*e* and 60*f* simultaneously with rotation of the driven roller 60*g*.

An extension 80 extends from the drive shaft 70 on which extension another gear 85 is positioned. The function of the extension 80 and gear 85 will become readily apparent in the discussion hereinbelow.

Referring to FIG. 1, the container 30*b* is a removable unit that may be manually attached to the stand 20 when operation of the processing module 10 is desired, or detached for maintenance or the like. Before discussing container 30*b* further, it is instructive to note that container 30*a* may or may not be removable; a non-removable unit 30*a* is illustrated in FIG. 1 for purposes of illustrating both types. The stand 20 includes a base 95 in which a plurality of notched-out grooves 100 are disposed for respectively receiving a plurality of corresponding mated legs 110 that are positioned on the bottom portion of the container 30*b*. The extensions 80 are respectively projected through a plurality of notched-out portions 120 in a side of the removable container 30*b* for permitting meshing of a drive shaft 130 with the gears 85, as will be described in detail below.

In this regard, the drive shaft 130 is longitudinally positioned between the two containers 30*a* and 30*b* in a rectangular-shaped box 140 for imparting rotation to the drive shafts 70, as will be described below. The box 140 includes a plurality of holes 150 in each of its two sides for respectively receiving the gears 85 from the two containers 30*a* and 30*b*. The drive shaft 130 includes gear teeth (not shown) therein on which a gear 85 of the drive shaft 70 rests. A motor 160 is disposed at one end of the processing module 10 and is attached to the drive shaft 130 for imparting rotation thereto.

Figure 3:
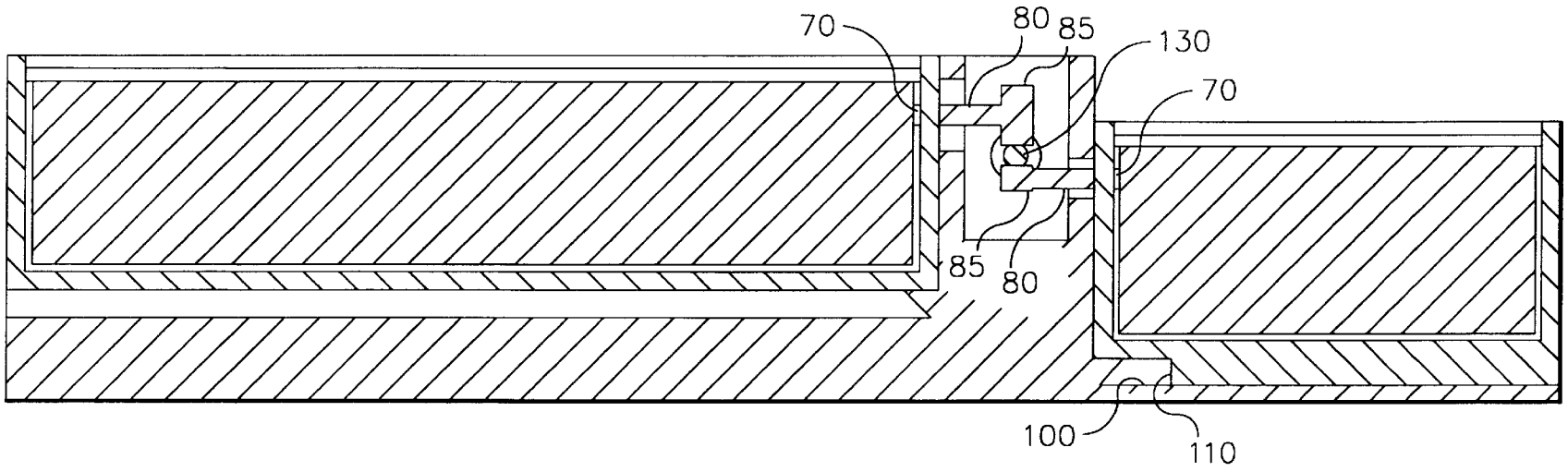
FIG. 3 is a side view in vertical cross section of the processing module.

Referring to FIG. 3, the gears 85 of the drive shafts 70 from the removable container 30*b* mate with the bottom portion of the drive shaft 130, and the gears 85 of the drive shafts 70 from the permanently attached container 30*a* mate with the top portion of the drive shaft 130. It facilitates understanding to reiterate that the gears 85 of the drive shafts 70 from each rack 50 of the two containers 30 rest on the same drive shaft 130.

Referring back to FIGS. 1 and 2, a cover 170 is positioned atop each container 30 for forming, in conjunction with the containers 30, an enclosed housing for the processing paths.

The operation of the processing module is as follows. The motor 160 is energized and imparts motion to the drive shaft 130 which, in turn, transmits rotation to the drive shafts 70 and, consequently, all the driven rollers 60. The photosensitive material is inserted into the first processing solution tank 50 of each container 30*a* and 30*b* so that the driven rollers drive the photosensitive material sequentially through each tank 50 that forms the processing paths. A media crossover (not shown) passes the photosensitive material between racks 50, as is well known in the art.

Figure 4:
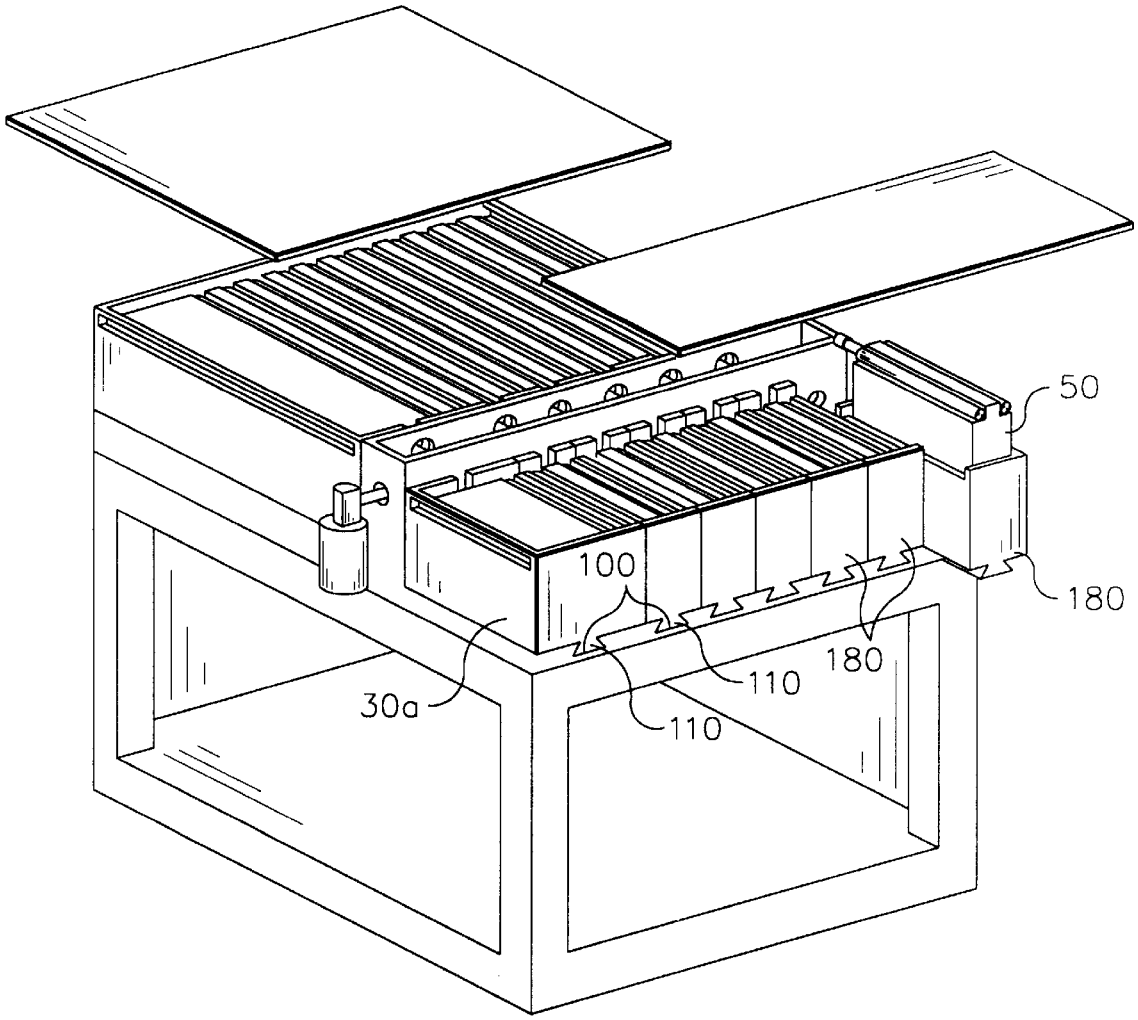
FIG. 4 is an alternative embodiment of FIG. 1.

Referring to FIG. 4, there is illustrated an alternative embodiment of the present invention. In this embodiment, the removable container 30*a* includes a plurality of sub-containers 180 each for containing a rack 50 therein. Each sub-container 180 includes a leg 110 thereon for respectively mating with the plurality of notched-out grooves 100 in the base 95.

The invention has been described with reference to a preferred embodiment. However, it will be appreciated that variations and modifications can be effected by a person of ordinary skill in the art without departing from the scope of the invention.

Parts List:

10 processing module
20 stand
30 container
30*a* container
30*b* container
40 tanks
50 U-shaped racks
55 channel
60 rollers
60*a* roller
60*b* roller
60*c* roller
60*e* roller
60*f* roller
60*g* roller
65 gears
65*a* gear
65*b* gear
65*c* gear
65*d* gear
65*e* gear
65*f* gear
65*g* gear
67 projection
68 projection
70 drive rollers
75 gears
80 extension
85 gears
90 drive link
95 base
100 notched-out grooves
110 mated legs
120 notched-out portion
130 main drive shaft
140 rectangular-shaped box
150 holes
160 motor
170 cover
180 sub-containers

What is claimed is:

1. A processing apparatus for processing of photographic material, the apparatus comprising:

(a) a first plurality of successive processing tanks, each containing a processing solution, said plurality of first tanks forming a first processing path for a first photographic material;

(b) a second plurality of successive processing tanks, each containing a processing solution, said second plurality of tanks forming a second processing path for processing a second photographic material, said first plurality of tanks being disposed adjacent said second plurality of processing tanks;

(c) a first transport system for driving of said first photographic material through said first processing path;

(d) a second transport system for driving of said second photographic material through said second processing path; and (e) a drive shaft for driving both said first and second transport systems.

2. The apparatus of claim 1 further comprising a single motor for driving said drive shaft.

3. The apparatus of claim 1, wherein said first and second transport systems include sequentially arranged tanks having a drive roller driving driven rollers.

4. A processing apparatus for processing of photographic material, the apparatus comprising:

(a) a stand having a receiving mechanism thereon;

(b) a container having a plurality of racks therein for forming a first processing path, said container having a plurality of sub-containers each individually attaching to the receiving mechanism for rigidly attaching said container to said stand;

(c) a shaft receiving the racks; and (d) a motor for causing said shaft to rotate which consequently causes said racks to urge the photographic material through the first processing path.

5. The processing apparatus as in claim 4, wherein said racks each include a drive roller that meshes with said shaft for ultimately permitting said racks to urge the photographic material through the first processing path.

* * * * *